United States Patent [19]

Huempfner

[11] 4,180,002

[45] Dec. 25, 1979

[54] TILTABLE TABLE

[75] Inventor: David F. Huempfner, Kewaunee, Wis.

[73] Assignee: American Hospital Supply Corporation, Evanston, Ill.

[21] Appl. No.: 923,843

[22] Filed: Jul. 12, 1978

[51] Int. Cl.[2] ..... A47F 5/12; A61G 13/00

[52] U.S. Cl. ..... 108/6; 269/323

[58] Field of Search ..... 269/323; 250/439; 248/11, 188.5, 178, 185, 371, 378; 108/1, 6; 297/377

[56] References Cited

U.S. PATENT DOCUMENTS

| | | | |
|---|---|---|---|
| 515,303 | 2/1894 | Rouze | 297/377 X |
| 520,630 | 5/1894 | Bramwell . | |
| 1,808,497 | 6/1931 | Dina | 248/11 |
| 1,854,296 | 4/1932 | Emmert | 269/323 |
| 2,186,660 | 1/1940 | Alopaeus | 5/62 |
| 2,346,919 | 4/1944 | Hillenbrand | 108/8 |
| 3,089,692 | 5/1963 | Blomovist | 269/323 |
| 3,293,667 | 12/1966 | Ohrberg | 269/323 |
| 3,615,088 | 10/1971 | Compton | 269/323 |
| 3,707,930 | 1/1973 | Yindra | 108/147 |
| 3,840,909 | 10/1974 | Detko | 5/62 X |
| 3,881,773 | 5/1975 | Rodaway | 297/377 |
| 3,888,444 | 6/1975 | Yindra et al. | 248/188.5 |
| 3,968,949 | 7/1976 | Romano, Jr. | 248/11 |

*Primary Examiner*—James T. McCall

*Attorney, Agent, or Firm*—Larry N. Barger

[57] ABSTRACT

A treatment table with a tiltable top for veterinary or hospital use. The tiltable top has a tilt locking mechanism that rigidly anchors the top with two pairs of laterally spaced pivot joints that prevent twisting of the table top when in a tilted position. A third pair of laterally spaced pivot joints connects the top to the base.

13 Claims, 5 Drawing Figures

TILTABLE TABLE

BACKGROUND

Tables with tiltable tops have been known in the past. There have been problems with such tiltable tops, particularly when the top was wide, and rigidly holding the top in a tilted position. A wide top would often twist and flex under a weight load that was not accurately centered on the table. Such twisting might occur in a veterinary table when an animal was shifted from side to side on the table.

In wide tilt-top tables, such as a drafting table as shown in U.S. Pat. No. 520,630, it was common practice to use an adjustable tilt rod on each side of the table. This was burdensome in that the operator had to separately adjust two rods on opposite sides of the table. It was difficult to coordinate the height of both rods, particularly if the table top was of a very light construction.

Another approach to tiltable table tops was to include a single centrally located tilt rod that did not require movement to opposite sides of the table to adjust. To prevent twisting of the table top, the tops were made extremely rigid and of a heavy construction. This made the table very heavy and difficult to move and also made the top construction expensive.

SUMMARY OF THE INVENTION

The present invention overcomes the problems of tiltable tables mentioned above by utilizing a single adjusting rod that is anchored to the table base by a pair of laterally spaced pivot joints and is anchored to the tiltable top by a second pair of laterally spaced pivot joints. Each pair of pivot joints can be connected by an axle having a length of from 4 to 24 inches. A tilt control rod is rigidly lockable to the two axles and slidably adjustable with respect to at least one axle to provide substantial lateral stability to a table top in tilted position.

THE DRAWINGS

DETAILED DESCRIPTION

Figure 1:
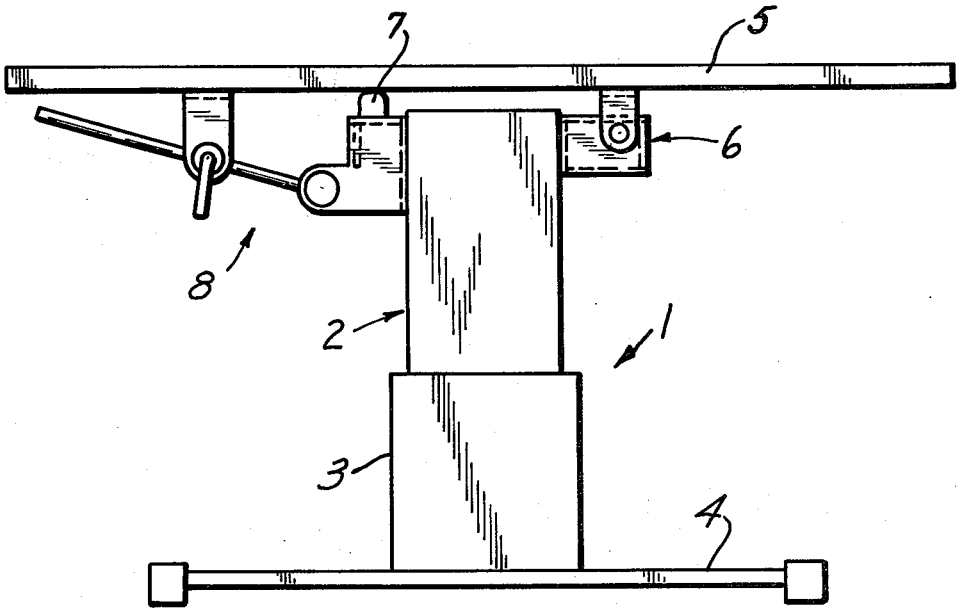
FIG. 1 is a side elevational view of the table with its top in horizontal position.

In FIG. 1, a treatment table, such as for use in veterinary and hospital patient treatment, includes a base section shown generally at 1 which includes a pair of rectangular telescoping sections 2 and 3 which can raise and lower the table top. The mechanism for raising and lowering the table can be that which is described in U.S. Pat. No. 3,707,930 and 3,888,444. Since the raising and lowering mechanism forms no part of this invention, a detailed description of the raising and lowering mechanism has been omitted. For lateral stability, a foot section such as 4, is preferably included in the base section 1.

The tiltable top 5 is shown pivotally connected to the table in a general area designated as 6. The detailed description of this pivot joint will be explained later. In its horizontal position, the table top may rest on one or more cushion pads 7. The tilt lock mechanism shown generally at 8 retains the top 5 in a horizontal position in FIG. 1. The positioning of the arm and pivot joints are located on the top and base at a position that prevents an overcenter toggling of the arm as the table tilt is changed.

Figure 2:
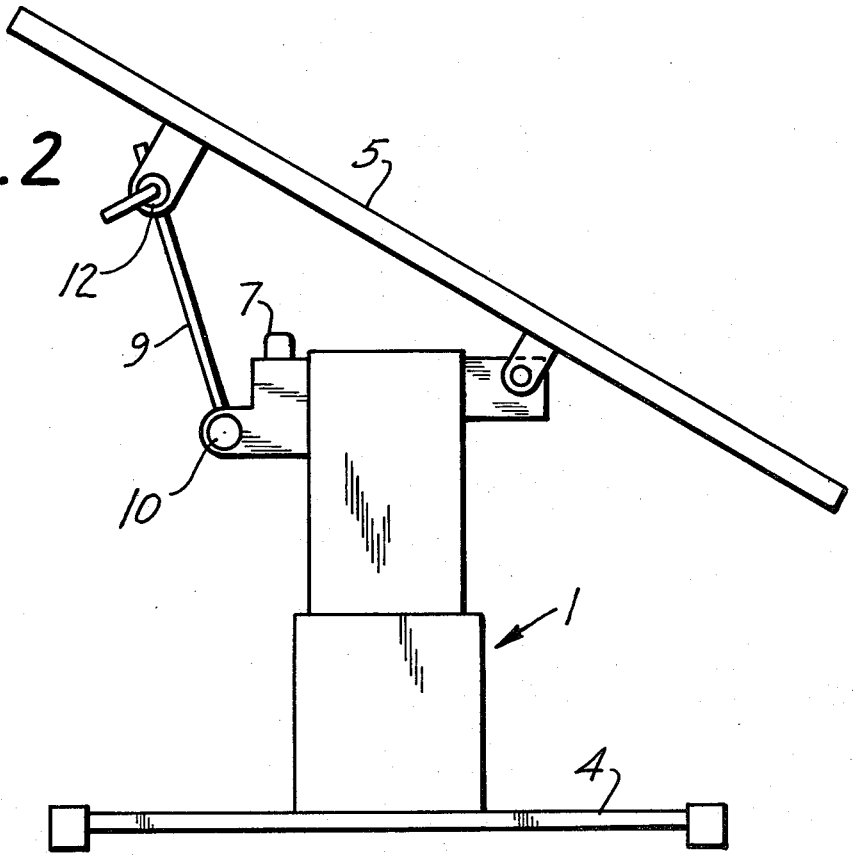
FIG. 2 is a view similar to FIG. 1, but showing the table top in tilted position.

When the table top 5 is tilted as shown in FIG. 2, a connecting rod 9 is locked in a different position between two pairs of laterally spaced pivot joints, one of each pair being shown at 10 and 12.

Figure 3:
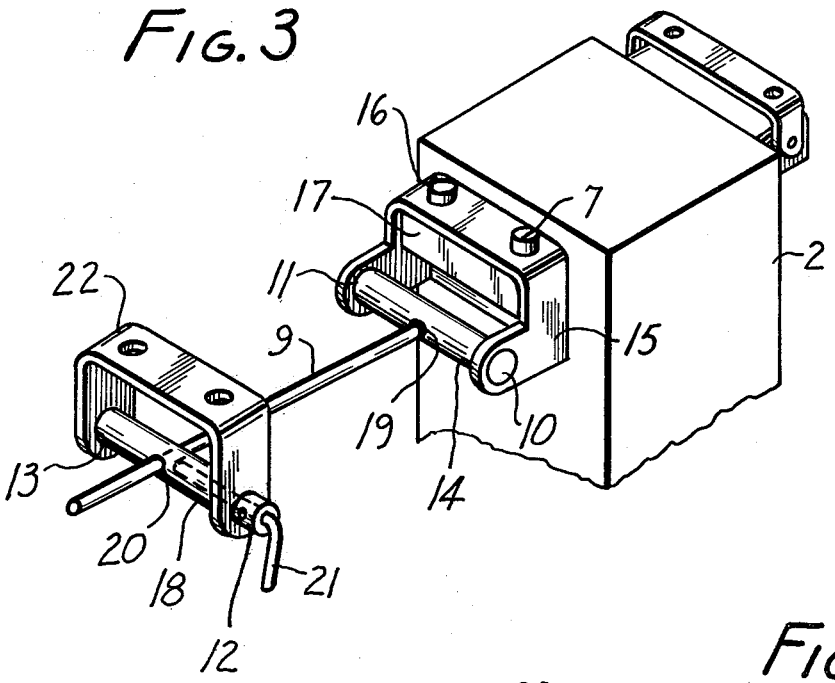
FIG. 3 is an enlarged sectional view of the tilt lock mechanism.

In FIG. 3, it can be seen that one pair of lateral pivot joints 10 and 11 are connected by an axle 14. Preferably, this axle has a length of from 4 to 24 inches. A mounting bracket 15 is secured to base section 2. In FIG. 3, two cushion pads 7 and 16 are shown. Additional cushion pads could be used, if desired. To help rigidify mounting bracket 15, a transverse brace 17 can be welded in the mounting bracket.

A second pair of laterally spaced pivot joints 12 and 13 are at ends of axle 18 that also is preferably between 4 and 24 inches long. Connecting rod 9 can be anchored to one axle by a weld, such as at 19. Spacing between axles 14 and 18 is controlled by connecting rod 9 sliding within an aperture 20 of axle 18. A threaded lock screw 21 fits in a hollow axle 18 and wedges connecting rod against a side of aperture 20. It is understood that aperture 20 could be in either one or both of axles 14 and 18. The important thing is to be able to longitudinally adjust the length of connecting rod 9 and then firmly anchor such connecting rod to the axles with their laterally spaced pivot joints. This is how the top is rigidly anchored against a twisting action. As shown in FIG. 3, the axle 18 can be mounted to the table top by a bracket 22.

Figure 4:
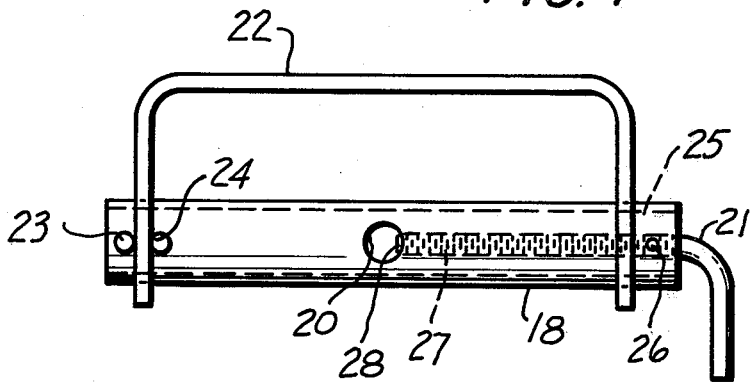
FIG. 4 is an enlarged front view of the spaced pivot joints and axle that are anchored to the table top.

In FIG. 4, the bracket 22 is pivotally secured to axle 18 by a pair of upstanding pins 23 and 24. An internally threaded collar 25 held in a hollow portion of axle 18 by plug weld 26 provides a support for lock screw 21. As shown in dotted lines, lock screw 21 is threaded in a section designated as 27. An inner end 28 of lock screw 21 wedges connecting rod 9 against an edge of aperture 20 to lock rod 9 and axle 18 together.

Figure 5:
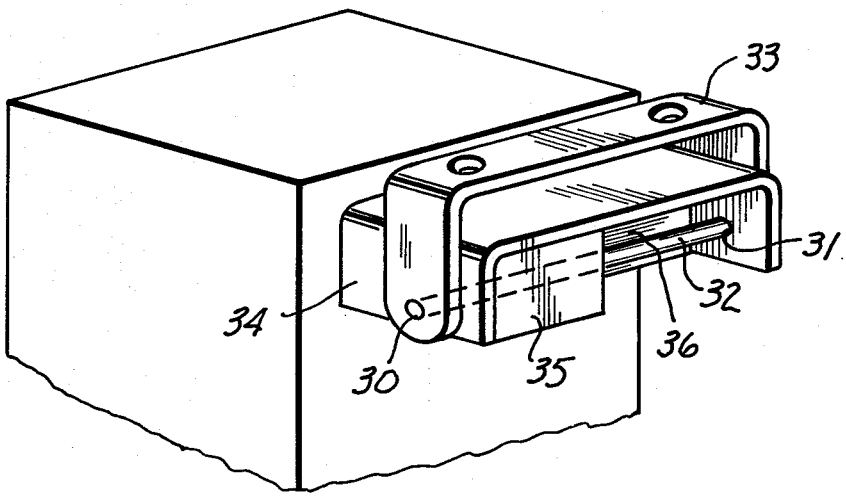
FIG. 5 is a prospective view of the third pair of laterally spaced pivot joints and axle connecting the top to the table base.

In FIG. 5, a third pair of spaced apart pivot joints 30 and 31 are at opposite ends of an axle 32 which preferably is between 4 and 24 inches long. A bracket 33 anchors to the table top and a separate bracket 34 anchors to a base 2 of the table. Bracket 34 can be rigidified by braces 35 and 36.

In the above description, a specific example has been used to describe the invention. However, it is understood by those skilled in the art that certain modifications can be made to this example without departing from the spirit and scope of the invention.

I claim:

1. A tiltable table with a top pivotally mounted to a base and having laterally spaced side edges, wherein the improvement comprises: a tilt lock mechanism that includes at least two laterally spaced pivot joints on the base; at least two laterally spaced pivot joints on the top; a connecting arm located approximately midway between the top's side edges and joined to the pivot joints; and a manipulable locking structure that simultaneously locks the connecting arm and laterally spaced pivot joints to rigidify the top, with the lateral distance between each pair of pivot joints being substantially greater than the width of at least a portion of the connecting arm.

2. A tiltable table as set forth in claim 1, wherein the connecting means is an arm permanently anchored to one pair of pivot joints and is longitudinally adjustable with respect to the other pair of pivot joints.

3. A tiltable table as set forth in claim 1, wherein at least two of the pivot joints on the base and at least two of the pivot joints on the top are each connected by a lateral axle.

4. A tiltable table as set forth in claim 3, wherein one axle has an aperature for slidingly receiving a connecting arm as a locking means to grip the axle to the arm to control the angle of tilt of the table top relative to the base.

5. A tiltable table as set forth in claim 4, wherein the arm and pivot joints are located on the top and base in a position that prevents overcenter toggling of the arm as the table tilt is changed.

6. A tiltable table as set forth in claim 4, wherein said one axle has a aperture through which the connecting arm is slidingly received.

7. A tiltable table as set forth in claim 6, wherein the axle has a hollow section with an internally threaded portion and a lock screw in the internally threaded portion that wedges the connecting arm against one side of the axle's aperture.

8. A tiltable table as set forth in claim 1, wherein the top is pivoted to the base by a third pair of laterally spaced apart pivot joints.

9. A tiltable table as set forth in claim 8, wherein the base and top have cushion stops to prevent banging of the top against the base when the top is lowered to a horizontal position.

10. A tiltable table as set forth in claim 1, wherein the base has a pair of generally flat opposed sides and at least one pair of pivot joints is anchored to one flat side of the base.

11. A tiltable table as set forth in claim 10, wherein the third pair of laterally spaced apart pivot joints are anchored to the other flat side of the base.

12. A tiltable table as set forth in claim 1, wherein the base is generally rectangular and has telescopic sections that raise and lower the top height.

13. A tiltable table as set forth in claim 1, wherein both pairs of laterally spaced pivot joints are connected by axles that have a length of from 4 to 24 inches.

* * * * *